United States Patent [19]

Mazuela

[11] 4,248,429

[45] Feb. 3, 1981

[54] METHOD OF USING BALL-IN-CUP GAME

[76] Inventor: Jose L. P. Mazuela, 105-A Mayer Rd., Singapore 15, Singapore

[21] Appl. No.: 40,101

[22] Filed: May 18, 1979

[51] Int. Cl.[3] ..... A63F 7/00

[52] U.S. Cl. ..... 273/123 R; 273/58 R; 273/118 R

[58] Field of Search ..... 273/59 R, 59 B, 118 R, 273/113, 58 R, 123 R

[56] References Cited

U.S. PATENT DOCUMENTS

| | | | |
|---|---|---|---|
| 742,416 | 10/1903 | Hall | 273/123 R X |
| 1,604,846 | 10/1926 | Nelson | 273/123 R |
| 1,614,471 | 1/1927 | Hayashi | 273/123 A |
| 3,408,072 | 10/1968 | Luchsinger | 273/123 A X |
| 3,743,288 | 7/1973 | Danklefsen | 273/59 B X |
| 4,148,487 | 4/1979 | Bouve | 273/127 B |

*Primary Examiner*—Robert L. Lindsay, Jr.

[57] ABSTRACT

A game comprises a group of adjacent blocks, each having generally a semi-spherical recession in its upper surface and an eccentrically weighted ball having a diameter substantially the same as that of the recessions. Through holes defined in the bottom of the blocks are sized to permit a player's fingers to extend therethrough to try to manipulate the ball so that it is moved from block to block in a prescribed order.

1 Claim, 5 Drawing Figures

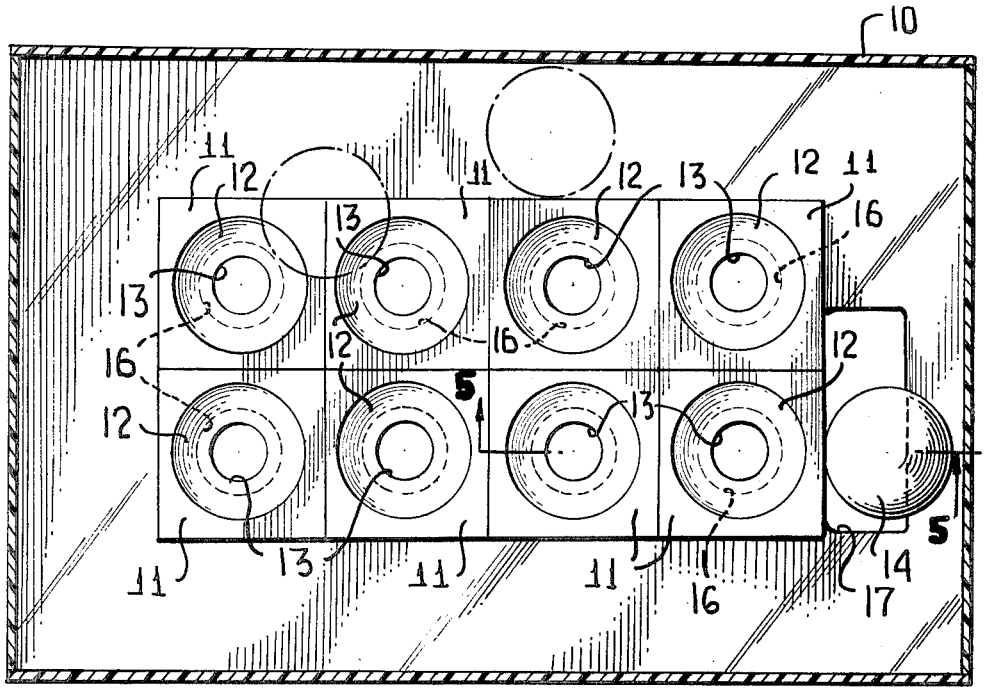
FIG.4
FIG.5
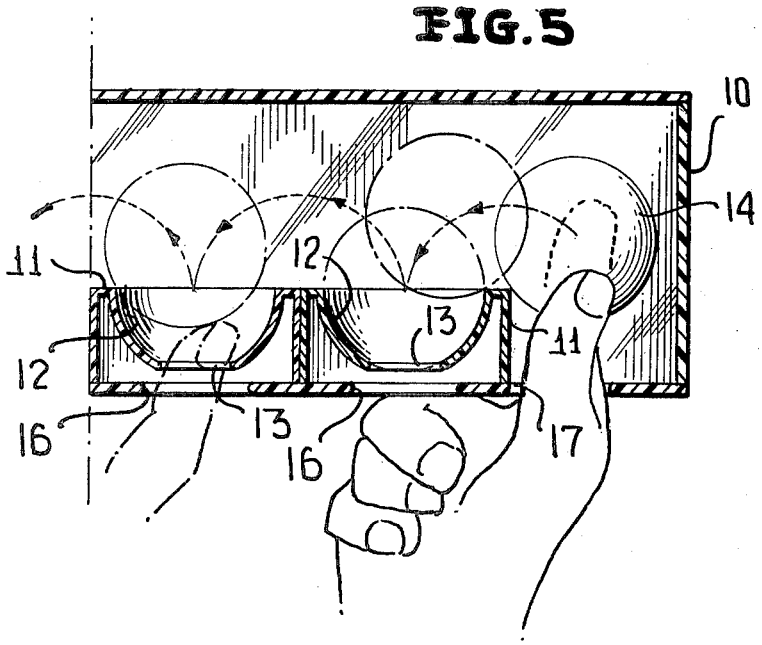

METHOD OF USING BALL-IN-CUP GAME

TECHNICAL FIELD

The present invention relates to games and amusement devices and, more particularly to such a device which requires digital dexterity while sustaining the interest of the player.

BACKGROUND ART

There are prior art games in which a ball or other object is intended to be moved from one playing area to another by the expedient of striking or pushing the ball through a hole in the bottom of the playing board with an implement of some kind. An example of such a game is found in U.S. Pat. No. 3,994,498. In such games very little manual dexterity or skill is required since the final resting place of the struck ball is largely dependent on chance.

It is an object of the present invention to provide a game of the general type described wherein digital dexterity is required to position the ball properly.

DISCLOSURE OF THE INVENTION

In accordance with the present invention a plurality of adjacent blocks are provided with top surface recesses of generally semispherical configuration. Each block has a hole defined through its bottom such that a player can insert a finger into the recess from underneath the block. A ball, having the same diameter as that of the recesses, is eccentrically weighted. The object of the game is to move the ball from block to block in a prescribed sequence by inserting a finger into the through holes underneath the blocks.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 4 is a top plan view of the game of the present invention; and

FIG. 5 is a view in partial section taken along lines 5—5 of FIG. 4.

BEST MODE OF CARRYING OUT THE INVENTION

Figure 1:
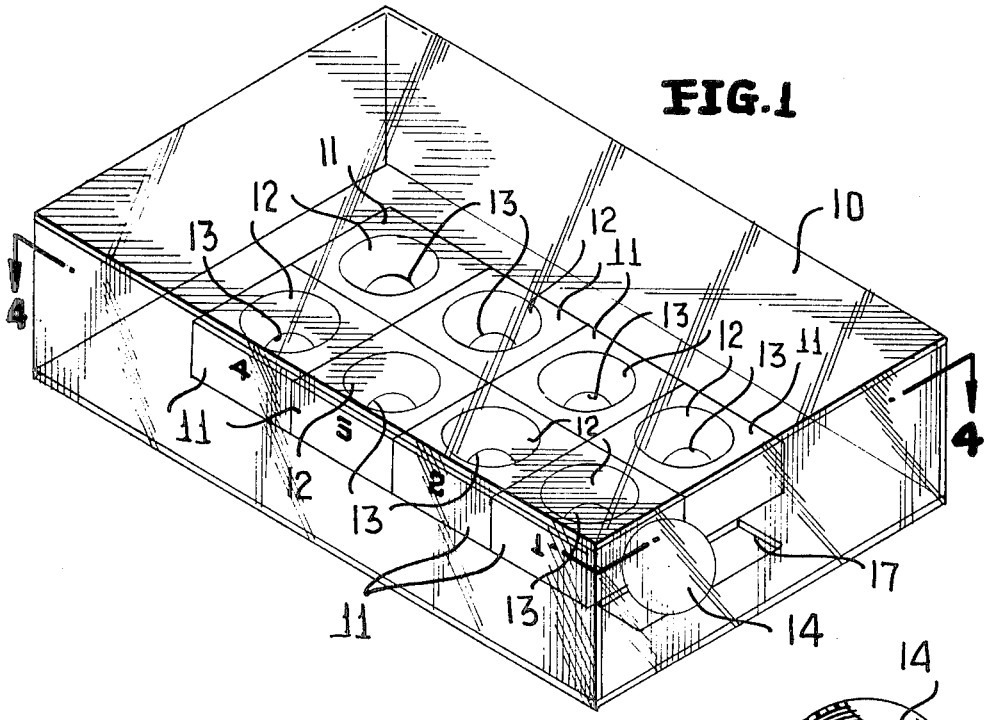
FIG. 1 is a view in perspective from above of the game of the present invention.

Referring to the drawings more specifically, the game of the invention is shown in a transparent plastic generally rectangular box 10. Such box is shown for purposes of convenience only and it is to be understood that the operative components of the game need not be enclosed in a box. A plurality (eight in the illustrated embodiment) of adjacent blocks 11 are disposed inside the box 10 and secured, by means of adhesive or the like, to the bottom of the box. In the particular embodiment illustrated the blocks are arranged in two rows of four blocks each; however, this is by way of example only and by no means limiting on the number or orientation of the blocks. It is desirable, however, that each block be disposed adjacent another block. Each block bears a different number in a sequence such that successive numbered blocks are adjacent one another.

Figure 2:
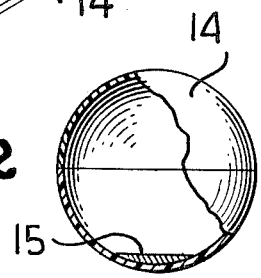
FIG. 2 is a view in section of a ball employed in the game of FIG. 1.
Figure 3:
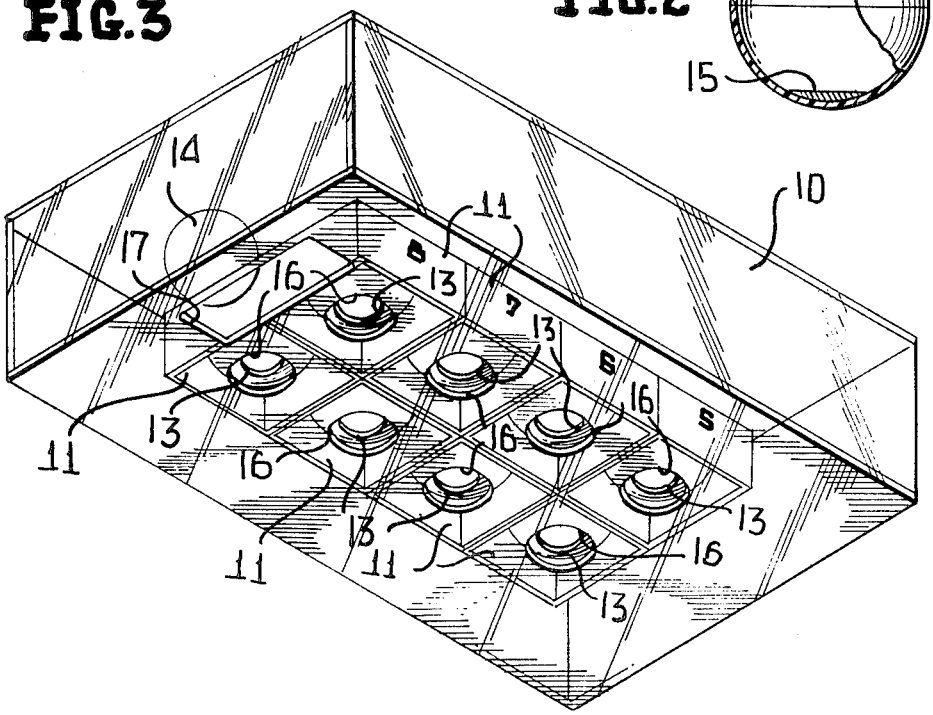
FIG. 3 is a view in perspective from below of the game of the present invention.

The top surface of each block has a semi-spherical recess 12 defined therein with a small hole 13 defined through the bottom of the recess 12 and the block 11. Holes 13 are sized to permit a player's finger to be comfortably inserted therethrough. A ball 14 is also located in box 10 and free to move throughout the box. Ball 14 has a diameter substantially the same as or slightly smaller than the diameter of recesses 12. As illustrated in FIG. 2, ball 14 has weighted material 15 secured at one point along its interior surface to render the ball eccentric and cause it to seek a stable position wherein weight 15 is at the lowermost part of the ball.

The bottom wall of box 10 includes eight holes 16 which are aligned with and at least as large as respective holes 13 in the block recesses. In the embodiment illustrated holes 16 are slightly larger in diameter than holes 13. A further hole 17, which by way of example only is rectangular, is defined through the bottom wall of box 10 adjacent the block 11 which bears the numeral 1. It is noted that the array of blocks 11 is spaced on all sides from the sides of box 10, thereby permitting hole 17 to be located adjacent either or both of the two exposed sides of block number 1.

The goal of the game is to move the ball 14 successively into the recesses of blocks 11 in the order of the numbers appearing on the blocks. The box 10 is initially tilted until ball 14 is rolled to overlie hole 17 which must of course be smaller than the ball. The player then uses his fingers in the manner shown in FIG. 5 to place the eccentric ball in block number 1. For this purpose hole 17 is preferably large enough for the player to grasp the ball with the thumb and index finger and lift the ball over the top and into block number 1. Thereafter the player inserts one finger through holes 16 and 13 to push the ball out of one block recess and direct it to the recess of the next numbered block in the sequence. The eccentric weighting of the ball renders this procedure considerably more difficult than it first appears since the ball tends to roll in a direction determined by the position of the weight, which direction may not be the same as the direction the ball is being pushed by the player. This becomes even more of a problem for the player if the ball bears no exterior markings which might indicate to the player where the weight is located.

The blocks 11 may be solid throughout their volume or hollow as shown. They are preferably made of plastic and may be colored differently from one another. The ball 14 is likewise preferably plastic, although it too may be made from other materials. The ball may be solid, rather than hollow as shown, as long as the weight distribution is eccentric.

It is contemplated that the game of the present invention may have use beyond the embodiment illustrated. In particular, the principles involved are readily adaptable to a coin-operated amusement device such as are located in arcades or other such area. For such use a tilting or other arrangement would automatically place the ball in the starting position upon insertion of a coin into the device. Weight sensors or appropriately provided metal contacts on the ball and in recesses 12 would sense the presence of the ball in the recesses. Wellknown state of the art logic circuitry could readily determine if the ball is located in the recesses in the prescribed sequence, and free plays could be awarded for each successful completion. For such an embodiment it is preferred that at least sixteen and preferably more blocks are utilized.

Clearly, the game described above requires considerable digital dexterity on the part of the player, particularly in view of the unpredictable movement of the eccentric ball. The result is a game that is difficult to master and likely to hold the interest of a player for considerable periods of time.

While I have described and illustrated one specific embodiment of my invention, it will be clear that variations of the details of construction which are specifically illustrated and described may be resorted to without departing from the true spirit and scope of the invention as defined in the appended claims.

I claim:

1. A method of playing a game with an apparatus having an eccentrically-weighted ball and a plurality of adjacent members with semispherical recesses defined in their top surfaces and a hole defined at the bottom of each recess, wherein said recesses have a diameter which matches the diameter of the ball and wherein said holes are smaller than the diameter of the ball but large enough to permit a player's finger to be inserted therethrough, the method comprising the steps of manipulating an eccentrically-weighted ball from recess to recess in a predetermined sequence of recesses by inserting a finger in at least one recess to raise the ball out of that recess and push it toward the next recess in the predetermined sequence.

* * * * *